US010751733B2

(12) United States Patent
Spiegel et al.

(10) Patent No.: US 10,751,733 B2
(45) Date of Patent: Aug. 25, 2020

(54) CENTRIFUGE ROTOR CORE WITH PARTIAL CHANNELS

(71) Applicant: ALFA WASSERMANN, INC., West Caldwell, NJ (US)

(72) Inventors: Kurt Spiegel, Pearl River, NY (US); Sandra Patricia Meriño, Weesp (NL); Blaine J. Marsh, Brogue, PA (US)

(73) Assignee: ALFA WASSERMANN, INC., West Caldwell, NJ (US)

( * ) Notice: Subject to any disclaimer, the term of this patent is extended or adjusted under 35 U.S.C. 154(b) by 48 days.

(21) Appl. No.: 15/599,722

(22) Filed: May 19, 2017

(65) Prior Publication Data

US 2017/0333917 A1 Nov. 23, 2017

Related U.S. Application Data

(60) Provisional application No. 62/338,563, filed on May 19, 2016.

(51) Int. Cl.

| | |
|---|---|
| ***B04B 7/08*** | (2006.01) |
| ***B04B 1/00*** | (2006.01) |
| ***B04B 5/04*** | (2006.01) |

(52) U.S. Cl.

CPC ..... *B04B 7/08* (2013.01); *B04B 1/00* (2013.01); *B04B 5/0442* (2013.01); *B04B 2005/0464* (2013.01)

(58) Field of Classification Search

CPC ..... B04B 7/08; B04B 1/00; B04B 5/0442; lB04B 2005/0464

See application file for complete search history.

(56) References Cited

U.S. PATENT DOCUMENTS

| | | | | |
|---|---|---|---|---|
| 3,498,531 | A * | 3/1970 | Chervenka | B04B 5/0442 494/12 |
| 3,556,967 | A * | 1/1971 | Anderson | G01N 27/4476 204/545 |
| 3,730,422 | A | 5/1973 | Cho | |
| 4,842,738 | A | 6/1989 | Greenspan | |
| 6,033,564 | A | 3/2000 | Kirker et al. | |
| 2003/0114289 | A1 | 6/2003 | Merino et al. | |
| 2014/0087360 | A1 | 3/2014 | Woodside | |

FOREIGN PATENT DOCUMENTS

| | | |
|---|---|---|
| JP | 62-53756 | 3/1987 |
| WO | 2016/064269 | 4/2016 |

OTHER PUBLICATIONS

Extended European Search Report dated Oct. 19, 2017 from corresponding European Patent Application No. 17172086.5, 9 pages.

* cited by examiner

*Primary Examiner* — Liam Royce
(74) *Attorney, Agent, or Firm* — Ohlandt, Greeley, Ruggiero & Perle, LLP

(57) ABSTRACT

A rotor core is provided that includes a rotor length defined along an axis of rotation and a plurality of separation channels. The plurality of separation channels having a channel length extending along the axis of rotation a distance that is less than the rotor length. A rotor assembly is also provided that includes such a rotor core removably disposed in an outer housing.

29 Claims, 11 Drawing Sheets

CENTRIFUGE ROTOR CORE WITH PARTIAL CHANNELS

CROSS REFERENCE TO RELATED APPLICATIONS

This application claims the benefit of U.S. Provisional Application Ser. No. 62/338,563 filed on May 19, 2016, the entire contents of which are incorporated by reference.

BACKGROUND OF THE INVENTION

1. Field of the Invention

The present disclosure is related to centrifuge rotor cores. More particularly, the present disclosure is related to centrifuge rotor cores having partial channels.

2. Description of Related Art

In the biological and chemical sciences, there is often a need to separate particulate matter suspended in a solution. In a biological experiment, for example, the particles typically are cells, subcellular organelles, viruses, virus like particles and macromolecules, such as DNA fragments. A centrifugation process is routinely used to perform the separation of these components from a solution.

One common centrifugation technique is tube rotor centrifugation, which employs a rotor that rotates or spins one or more tubes containing the one or more desired analytes for separation. While useful for separation of small volumes as may be needed for laboratory use during product development, the use of such tube rotor centrifugation techniques may not be considered to be rapid enough and/or to be cost effective enough for certain uses such as those common in a production environment. Thus, tube rotor centrifugation techniques have generally not proven to be easily scalable from the benchtop or lab environment to the production environment.

Another common centrifugation technique is continuous flow centrifugation, which employs a rotor and rotor core that rotates or spins as the desired analyte or analytes flow continually over a density gradient maintained within the rotor assembly. Such continuous flow centrifugation techniques can include various different process steps including, but not limited to static gradient loading, static gradient unloading, loading of an unmixed or discontinuous gradient, loading of a layered or step gradient, dynamic gradient loading, dynamic gradient unloading, loading of mixed or linear or continuous gradients, and any combinations thereof.

As disclosed in U.S. Publication No. 2003/0114289A1, which is incorporated herein in its entirety and is commonly owned by the Applicant of the present disclosure, continuous flow centrifugation can, in some instances, be configured for linear scalability, for separations of different volumes or quantities, e.g., from laboratory scale to pilot scale to industrial scale or from industrial scale pilot scales to laboratory scale, using the same or similar centrifugation systems. The method and apparatus allow the same centrifuge systems can be used for sedimentation processes of multiple scales while maintaining substantially the same separation characteristics for each process by, at least in part, interchanging different sized and configured rotor cores within the rotor housing.

It has been determined by the present disclosure that the rotor cores disclosed herein, which include a partial channel, provide enhancements and improvements to the prior art scalable continuous flow centrifugation.

SUMMARY

A rotor core is provided that has a plurality of partial channels, namely channels that extend less than an entire length of the rotor core.

A rotor assembly is provided that has an outer housing with a removable rotor core disposed therein. The rotor core has a plurality of partial channels, namely channels that extend less than an entire length of the rotor core.

A method for achieving a linear scale separation of particles of a product during centrifugation is provided. The method includes operating a centrifuge apparatus at certain predetermined parameters depending upon a product to be separated; placing a first rotor core in a rotor housing to define a first rotor assembly having a first volume capacity; rotating the first rotor assembly in the centrifuge apparatus and so as to achieve a first particle separation of the product; removing the first rotor core from the rotor housing and placing a second rotor core in the rotor housing to define a second rotor assembly having a second volume capacity; and rotating the second rotor assembly in the centrifuge apparatus so as to achieve a second particle separation of the product which is a linear scale with respect to the first particle separation. The first and second rotor cores have a common rotor length and each have a plurality of channels with a channel length. The channel length of at least one of the first and second cores being less than the common rotor length. Additionally, the channel length of the plurality of channels of the first rotor core is different than the channel length of the plurality of channels of the second rotor core.

The above-described and other features and advantages of the present disclosure will be appreciated and understood by those skilled in the art from the following detailed description, drawings, and appended claims.

DETAILED DESCRIPTION OF THE INVENTION

Figure 1:
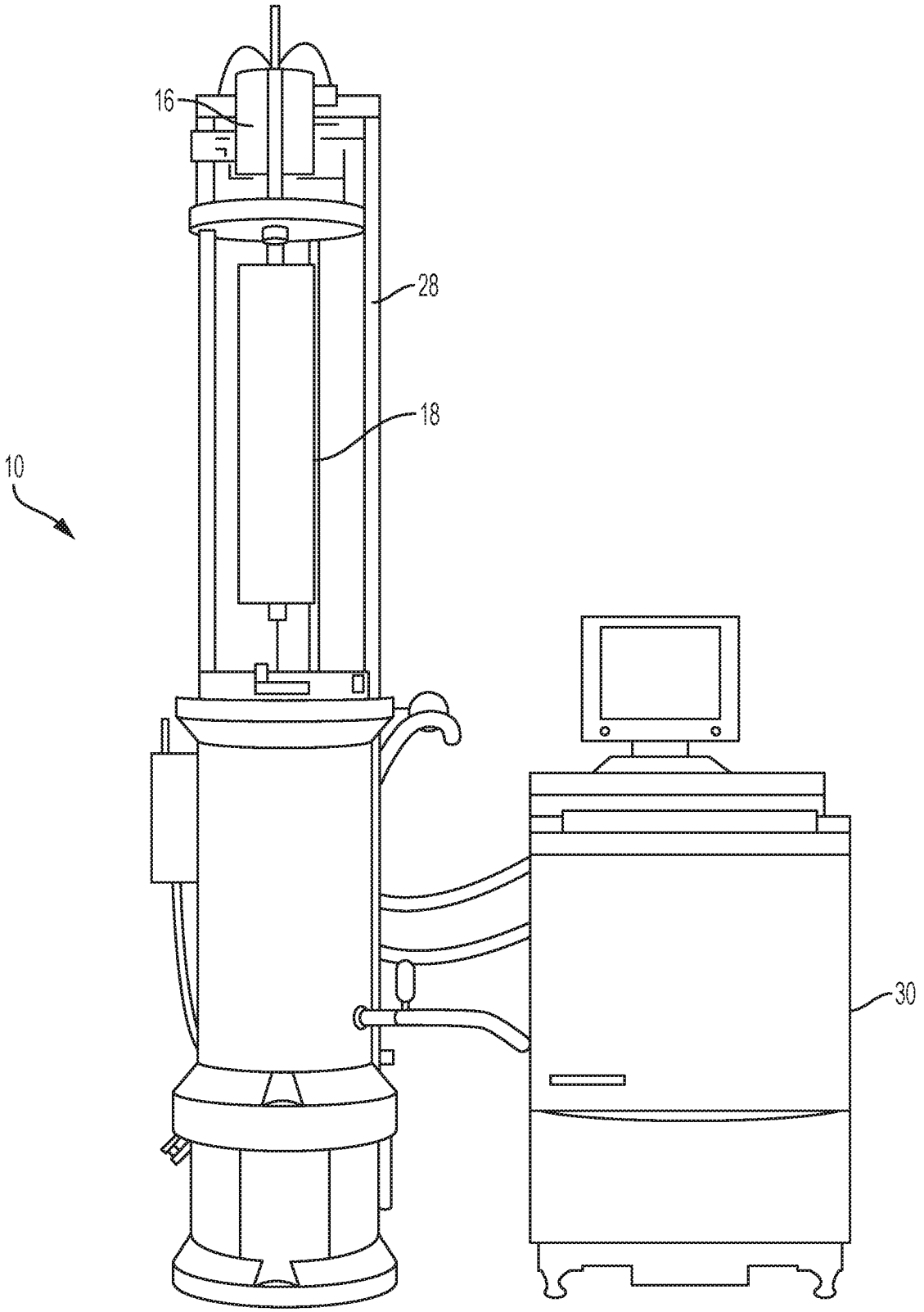
FIG. 1 is a front elevational view of a centrifuge apparatus according to the present disclosure.

Referring to the drawings and in particular with simultaneous reference to FIGS. 1-4, a centrifuge apparatus 10 according to the present disclosure is shown in use with an exemplary embodiment of rotor core 12 having a plurality of separation channels 14 defined therein.

Advantageously, rotor core 12 allows centrifuge apparatus 10 to be utilized in a process for separating components of a product sample in which the volume of the product sample can be scaled up or down while maintaining substantially the same selected separation parameters of the process or to enable one centrifuge to be used for multiple scale processes that do not necessarily need to be scaleable but should have a similar functioning process.

According to the present disclosure rotor core 12 has channels 14 with a channel length ($C_L$that extends less than an overall length of the rotor core, referred to herein as a rotor length ($R_L$). Thus, rotor cores 12 of the present disclosure are referred to as having "partial channels", namely having channels 14 that extends less than the entire length of the rotor core. In some embodiments, channel length ($C_L$) is between 5% and 90% of rotor length ($R_L$), preferably between 20% and 80%, with between 25% and 75% being most preferred, and any subranges between these ranges.

Exchanging a rotor core 12 having channels 14 of a first partial channel length ($C_L$) in centrifuge assembly 10 with a rotor core 12 having channels 14 of a second channel length ($C_L$)—where the second channel length is longer or shorter than the first—allows different volumes of analyte or analytes to be processed in a linearly scaled essentially similar manner.

Rotor core 12 has channels 14 with a channel width ($C_W$)—where the channel width ($C_W$) and channel length ($C_L$), as well as the number of channels, define the volume of the rotor core. Since the present disclosure provides rotor cores 12 having partial channels 14, the channel width ($C_W$) is increased to provide the same volume as rotor cores having longer channels. Stated another way, by providing rotor cores 12 having channels 14 of partial or limited channel length ($C_L$), the rotor cores having increased or wider channel widths ($C_W$). As used herein, the channel width ($C_W$) is defined as a measurement of arc length of channel 14 at the outer diameter of rotor core 12.

Without wishing to be bound by any particular theory, it is believed that rotor cores 12 of the present disclosure—that have partial channels 14—provide increased stability of the separation gradient during rotation by centrifuge apparatus 10. Simply stated, partial channels 14 of the present disclosure are shorter than the channels of the prior art and assuming a common channel volume, result in wider channels than those of the prior art. It is believed that the short, wide partial channels 14 of the present disclosure provide increased stability of the separation gradient during rotation by centrifuge apparatus 10.

It is also believed that increased gradient stability provides an environment where the density gradient 'profile' can be retained for a substantially longer period of time and therefore allow for a process to be conducted where the analyte or analytes can be successfully collected and the gradient remain in an essentially similar profile as compared to each other. This means that the analyte or analytes accumulation and resolution of impurities remains essentially the same for either scale of operation hence they are of a linear scale.

In some embodiments, rotor core 12 has an aspect ratio of channel width ($C_W$) to channel length ($C_L$) from 10:1 to 1:10, preferably 1:1 to 1:10, more preferably from 1:1 to 1:5, with 1:1 to 1:3 being most preferred, and any subranges there between.

Centrifuge 10 includes a tank assembly within which is housed a drive motor 16 and a rotor assembly 18. Drive motor 16 is used to spin rotor assembly 18 at speeds sufficient for separation of the desired analyte or analytes.

Rotor assembly 18 includes an outer rotor housing 20 with removable rotor core 12 positioned therein. Housing 20 includes a central portion 22 and a pair of end caps 24, 26. At least one of end caps 24, 26 is selectively removable from central portion 22 so as to allow rotor core 12 to be inserted or removed from housing 20. In some embodiments, one of end caps 24, 26 can be permanently connected to or integrally formed with the central portion 22.

In some embodiments, centrifuge apparatus 10 can include a lift assembly 28 to raise one or more of drive motor 16 and the rotor assembly 18. Additionally, centrifuge apparatus 10 can include a console assembly 30, which is in communication with drive motor 16 and, when present, lift assembly 28 to control the respective functions thereof.

In this manner, rotor cores 12 having channels 14 of differing channel lengths ($C_L$) can be received in rotor assembly 18 and the rotor assembly can be installed in the centrifuge apparatus 10 to process—preferably in a linearly scalable manner—differing volumes of analyte or analytes.

In some embodiments, rotor assembly 18 includes an insert 32 at a first face 34 and/or a second face 36 of rotor core 12. In the illustrated embodiment, insert 32 is removable in a bore 38 of rotor core 12 located by a pair of pins 40, a spring 42, and a seal or O-ring 44. Spring 42 normally biases insert 32 upwards along pins 40 away from faces 34, 36. In this manner, insert 32 can assist in seating rotor core 12 in housing 20 and end caps 24, 26 in a desired manner.

Figure 2:
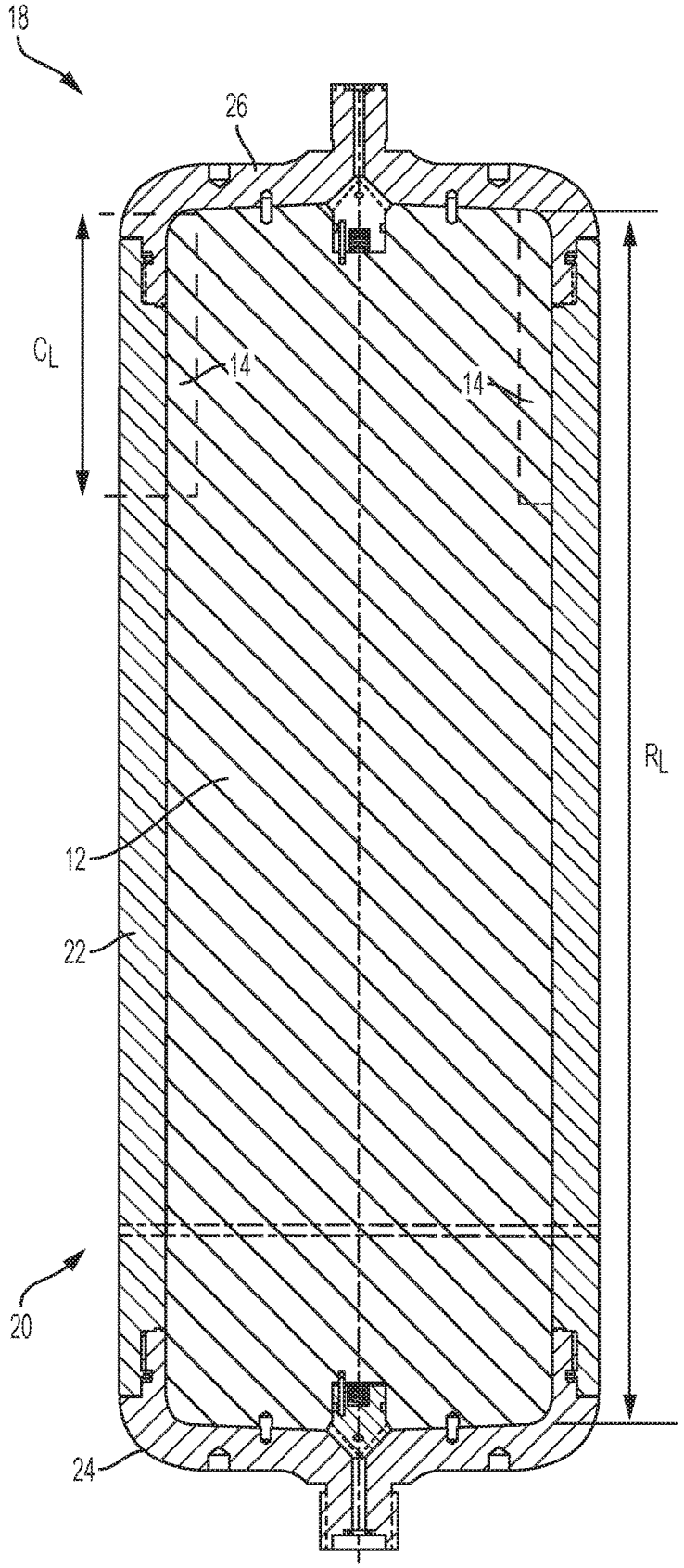
FIG. 2 is a sectional view of an exemplary embodiment of a rotor assembly according to the present disclosure.
Figure 4:
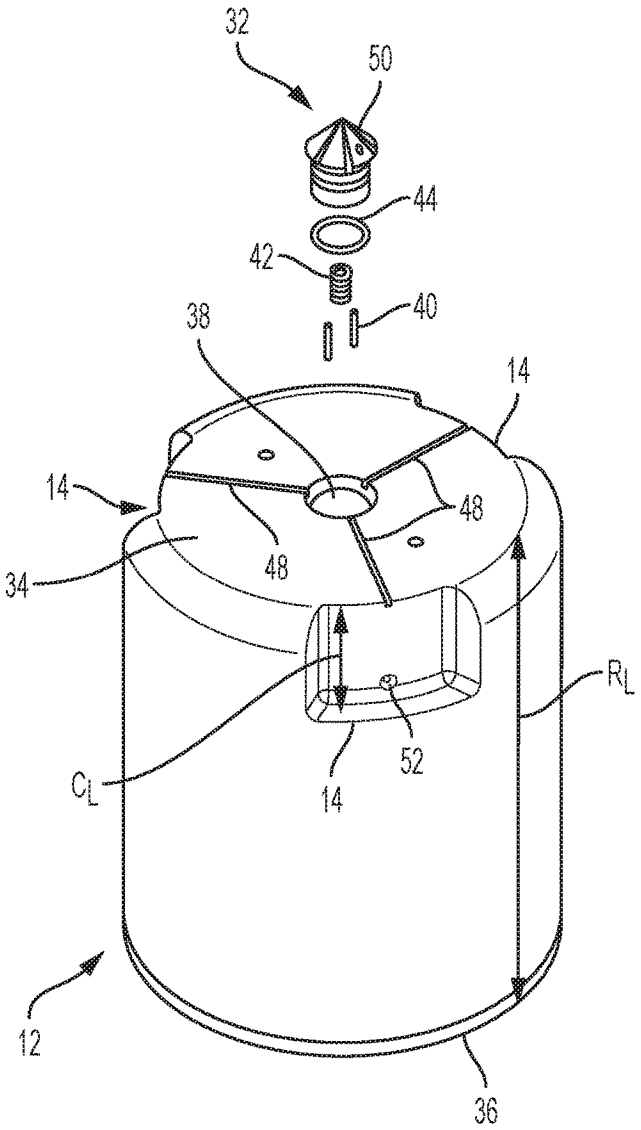
FIG. 4 is a partially exploded view of the rotor core according of FIG. 3.
Figure 6:
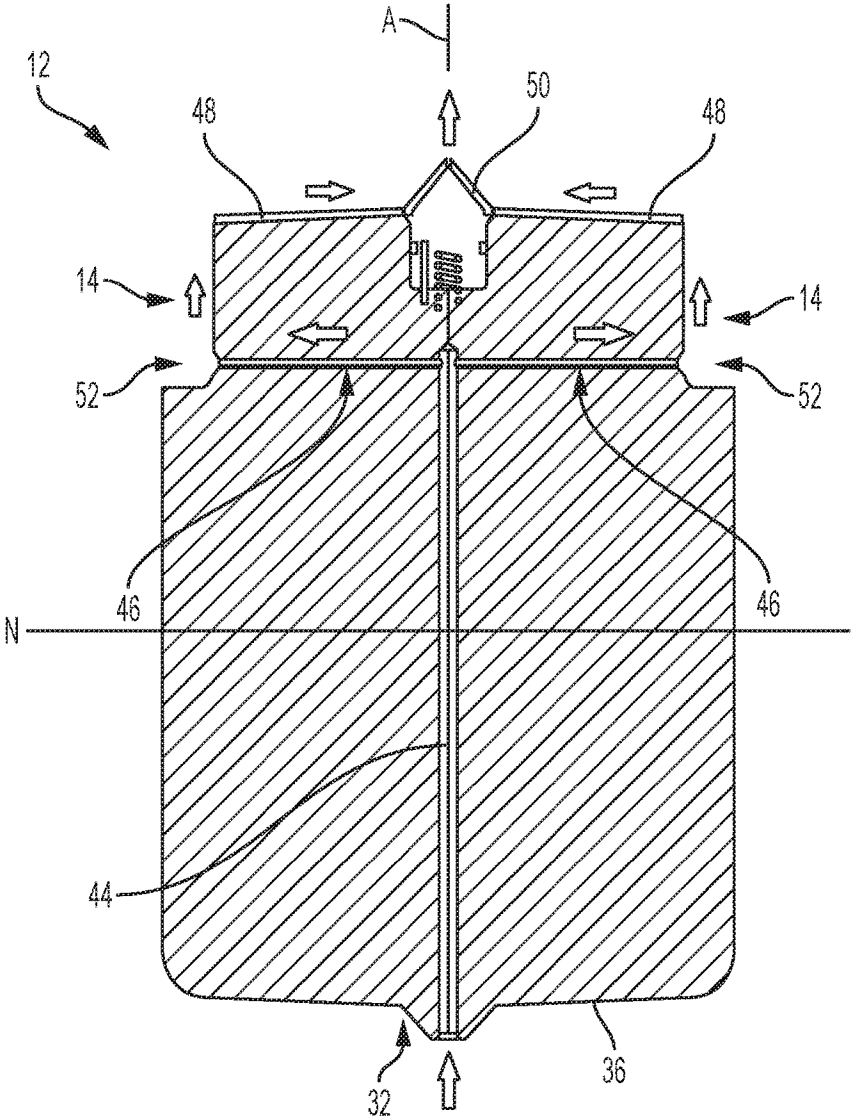
FIG. 6 is a schematic view of an alternate exemplary embodiment of a flow path through the rotor core of FIG. 3.
Figure 5:
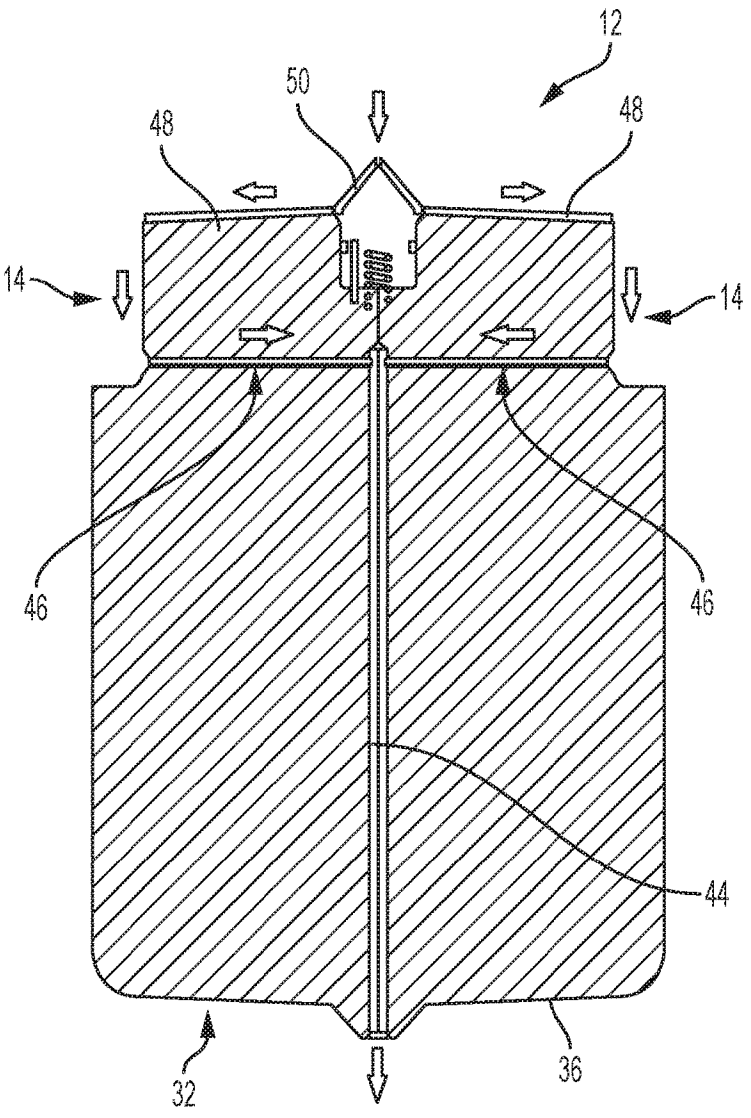
FIG. 5 is a schematic view of a first exemplary embodiment of a flow path through the rotor core of FIG. 3.
Figure 9:
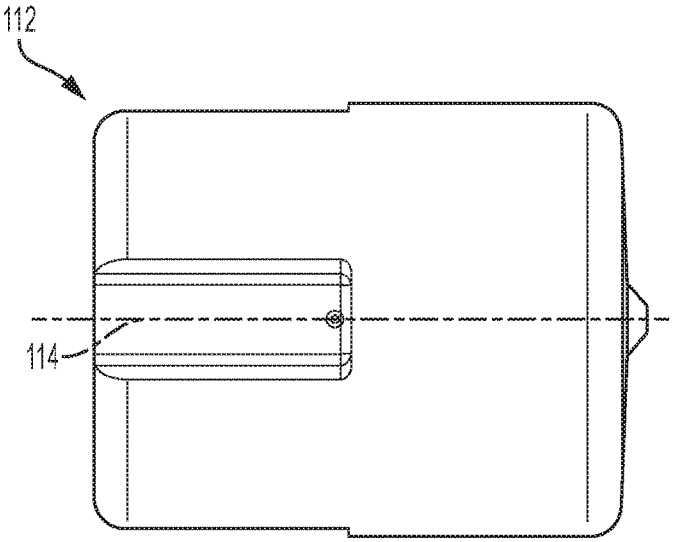
FIG. 9 is a side view of the rotor core of FIG. 7.
Figure 10:
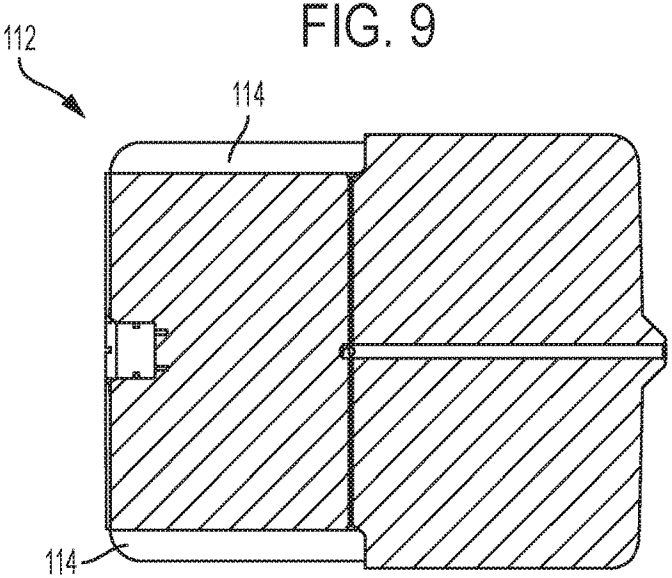
FIG. 10 is a sectional view of the rotor core of FIG. 7.
Figure 7:
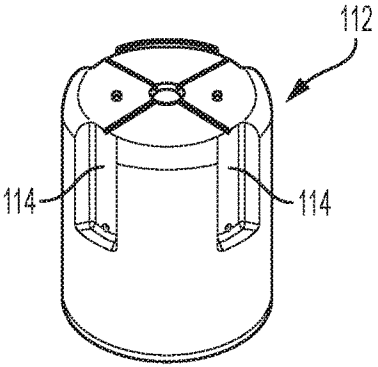
FIG. 7 is a top perspective view of an alternate exemplary embodiment of a rotor core according to the present disclosure.
Figure 8:
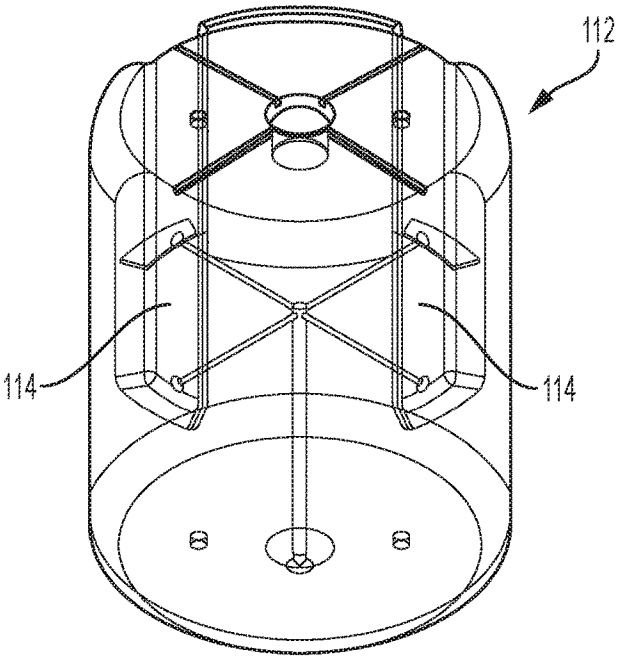
FIG. 8 is a view of the rotor core of FIG. 7 illustrating flow channels.
Figure 13:
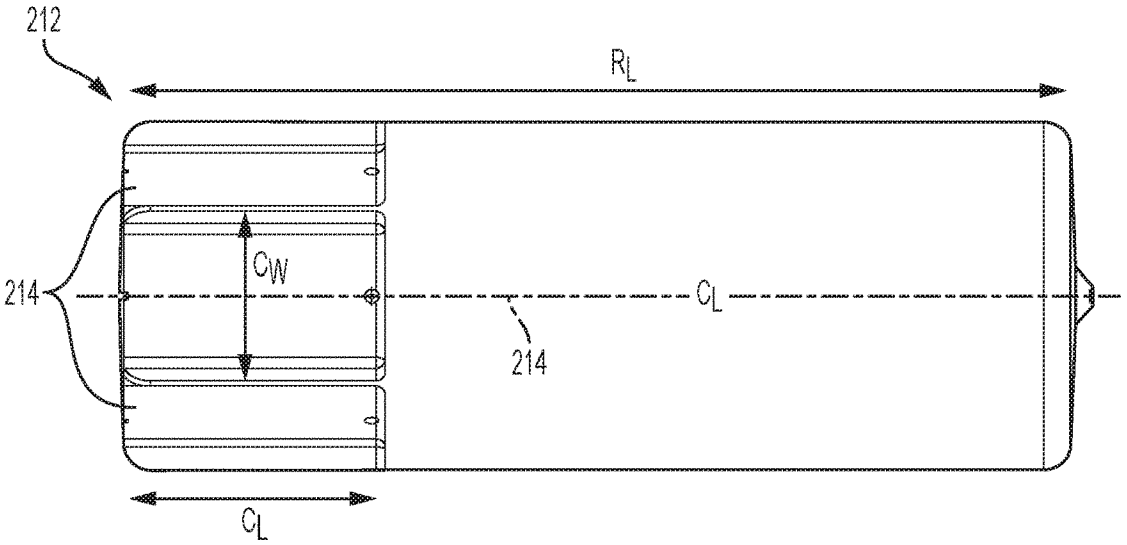
FIG. 13 is a side view of the rotor core of FIG. 11.
Figure 14:
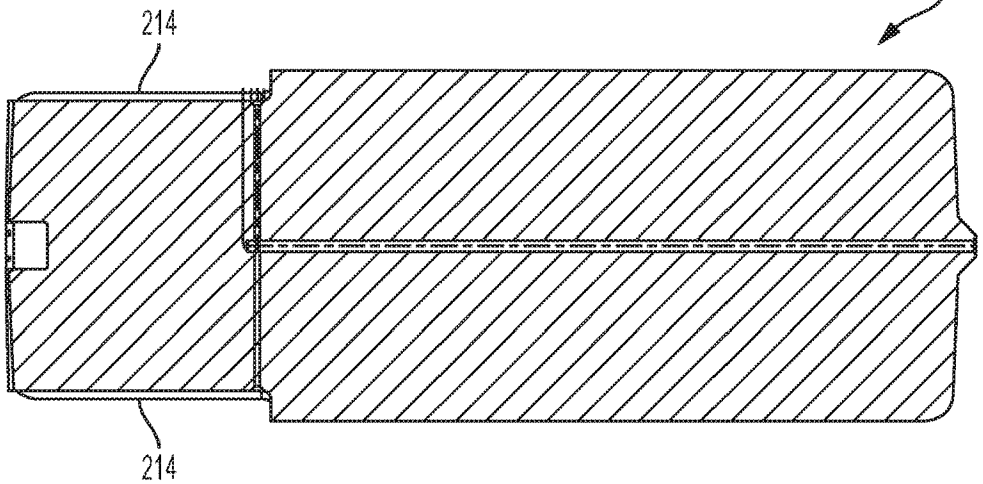
FIG. 14 is a sectional view of the rotor core of FIG. 11.
Figure 12:
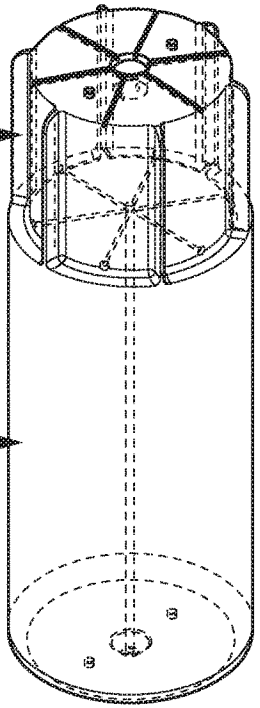
FIG. 12 is a view of the rotor core of FIG. 11 illustrating flow channels.
Figure 11:
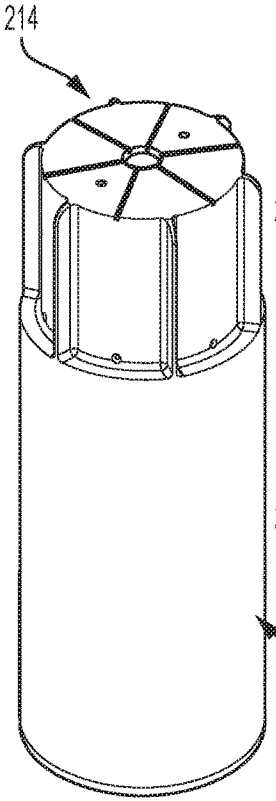
FIG. 11 is a top perspective view of another alternate exemplary embodiment of a rotor core according to the present disclosure.

While rotor core 12 is illustrated in FIG. 2 having insert 32 at both faces 34, 36, it is contemplated by the present disclosure for the rotor core to have at least one of the inserts integrally formed therewith as illustrated in FIGS. 5-6. Without wishing to be bound by any particular theory, it is believed by the present disclosure that rotor core 12 having integral insert 32 at least at one of faces 34, 36, improved flow through rotor assembly 18 by eliminating a region of reduced flow (i.e., dead leg) that can form around the insert. Although not illustrated, it is contemplated by the present disclosure for both inserts 32 to be integral to rotor core 12.

Figure 3:
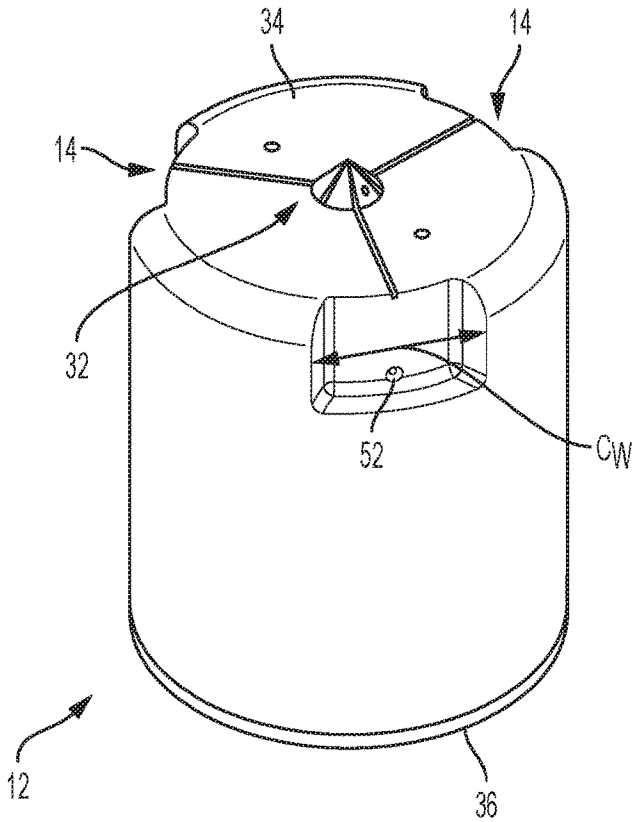
FIG. 3 is a top perspective view of an exemplary embodiment of a rotor core according to the present disclosure.

A first exemplary embodiment of the flow path through rotor core 12 of FIG. 3 is illustrated in FIG. 5, and an alternate, opposite flow path through the rotor core is illustrated in FIG. 6.

Rotor core 12 of FIGS. 3-4 and 5-6 includes a flow path defined by an axial channel 44, a plurality of radial channels 46, the plurality of separation channels 14, a plurality of face channels 48, and, when insert 32 is present, a plurality of insert channels 50. Preferably, the number of separation channels 14 is common with the number of radial and face channels 46, 48. Of course, it is contemplated by the present disclosure for core 12 to not include insert 32 and here, the core includes any desired number of face channels 48 such as six or less channels, more preferably four channels.

As shown in FIG. 5, centrifuge apparatus 10 can be operated so that the flow of analyte or analytes through the flow path enters rotor core 12 at insert 32 proximate face 36, passes axially through the rotor core via axial channel 44, passes radially through the rotor core via radial channels 46, and enters separation channels 14. After passing through separation channels 14, which include a density gradient, any unseparated analyte or analytes and/or flow through passes over face 34 via face channels 48, then over insert 32 via insert channels 50 before exiting rotor assembly 18.

Preferably, core 12 includes a port or opening 52 connecting radial channels 46 and separation channels 14 that includes a taper such that the port is wider at an interface with separation channels 14. Without wishing to be bound by any particular theory, the taper of port 52, when the flow path is as illustrated in FIG. 5, spreads the particles in the analyte or analytes across a greater area of the separation gradient, which can mitigate the impact of the particles on the gradient and maintain the separation performance (e.g., stability) of the gradient. Simply, it is believed that the momentum of the analyte or analytes and/or flow through traveling radially outward can physically disrupt or cut through the gradient in separation channels 14. The taper of port 52 is believed to lessen this effect by spreading the momentum across a larger area of the gradient.

It should be recognized that radial channels 46 are illustrated as being perpendicular to an axis of rotation (A) of rotor core 12. Of course, it is contemplated by the present disclosure for radial channels 46 to be angled with respect to a normal line (N) through the axis (A). For example, it is contemplated by the present disclosure for radial channels 46 to angled with respect to the normal line (A) by between ±30 degrees, more preferably between ±10 degrees, with ±5 degrees being most preferred, and any subranges there between.

Again without wishing to be bound by any particular theory, it is believed by the angle of radial channels 46 can be used to slow or reduce the momentum with which the analyte or analytes and/or flow through impacts the gradient in separation channels 14. For example, the momentum flow through radial channels 46 of FIG. 5 can be slowed by providing the radial channels with a downward angle with respect to normal line (A).

Conversely and as shown in FIG. 6, centrifuge apparatus 10 can be operated so that the flow of analyte through the flow path enters rotor core 12 at insert 32 proximate face 34. Here the flow passes or analytes over insert 32 via insert channels 50, passes over face 34 via face channels 48, where the flow enters separation channels 14. After passing through separation channels 14, which include a centrifugation gradient, any unseparated analyte or analytes and/or flow through passes enters rotor core 12 via radial channels 46, flows into radial channel 44, and exits rotor core 12 at insert 32 at face 36.

Referring now to FIGS. 7 through 10, another alternate embodiment of rotor core 112 is shown. Here, rotor core 112 has the same geometry and dimensions including rotor length ($R_L$) and channel width ($C_W$) as rotor core 12 shown in FIGS. 3 through 6. However, rotor core 112 has partial channels 114 with have a channel length ($C_L$) that results in a volume of rotor core 112 that is 100 ml.

Accordingly, it can be seen that use of rotor assembly 18 in centrifuge assembly 10 can be easily scaled, in a linear manner, by starting with the rotor core 12 of FIGS. 3 through 6 that has a volume of 50 ml, then using the rotor core 112 of FIGS. 7 through 10 that has a volume of 100 ml.

It should be recognized the present disclosure is illustrated above with respect to rotor cores 12 and 112, which have three separation channels 14, 114. Of course, it is contemplated by the present disclosure for rotor cores having any desired number of separation channels.

For example, and referring to FIGS. 11 through 14, another alternate embodiment of rotor core 212 is shown. Here, rotor core 212 includes six partial channels 214 with have a channel length ($C_L$) that is 25% of rotor length ($R_L$). Further, it is contemplated by the present disclosure for rotor core 212 to have any desired channel length ($C_L$) that less than rotor length ($R_L$).

Figure 15:
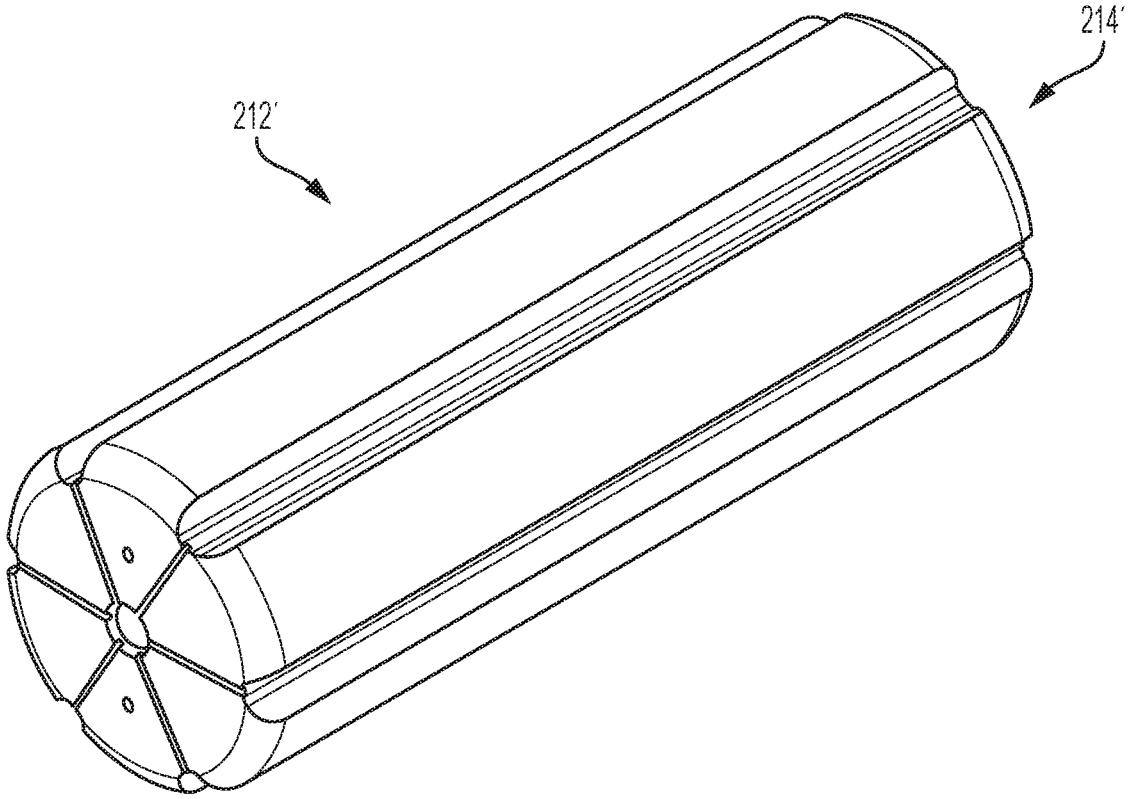
FIG. 15 PRIOR ART
FIG. 15 is a top perspective view of a prior art rotor core used to compare to the rotor core of FIG. 11.

Rotor core 212 of FIGS. 11 through 14 has partial channels 214 and can be compared to the prior art rotor core 212' shown in FIG. 15. Rotor core 212' is commercially available from the Applicant under the tradename PK3-400.

For ease of comparison, rotor core 212 and rotor core 212' have a common rotor volume of 400 ml. Here, rotor core 212 has partial channels 214 with channel length ($C_L$) that is less than the rotor length ($R_L$). By contrast, while the prior art rotor core 212' has channels 214' with a channel length ($C_L$) that is equal to the rotor length ($R_L$)—namely lacks the partial channels of the present disclosure. As a result, channels 212 have a channel width ($C_W$) that is substantially wider than the channel width ($C_W$) of rotor core 212' but have the same volume.

Figure 16:
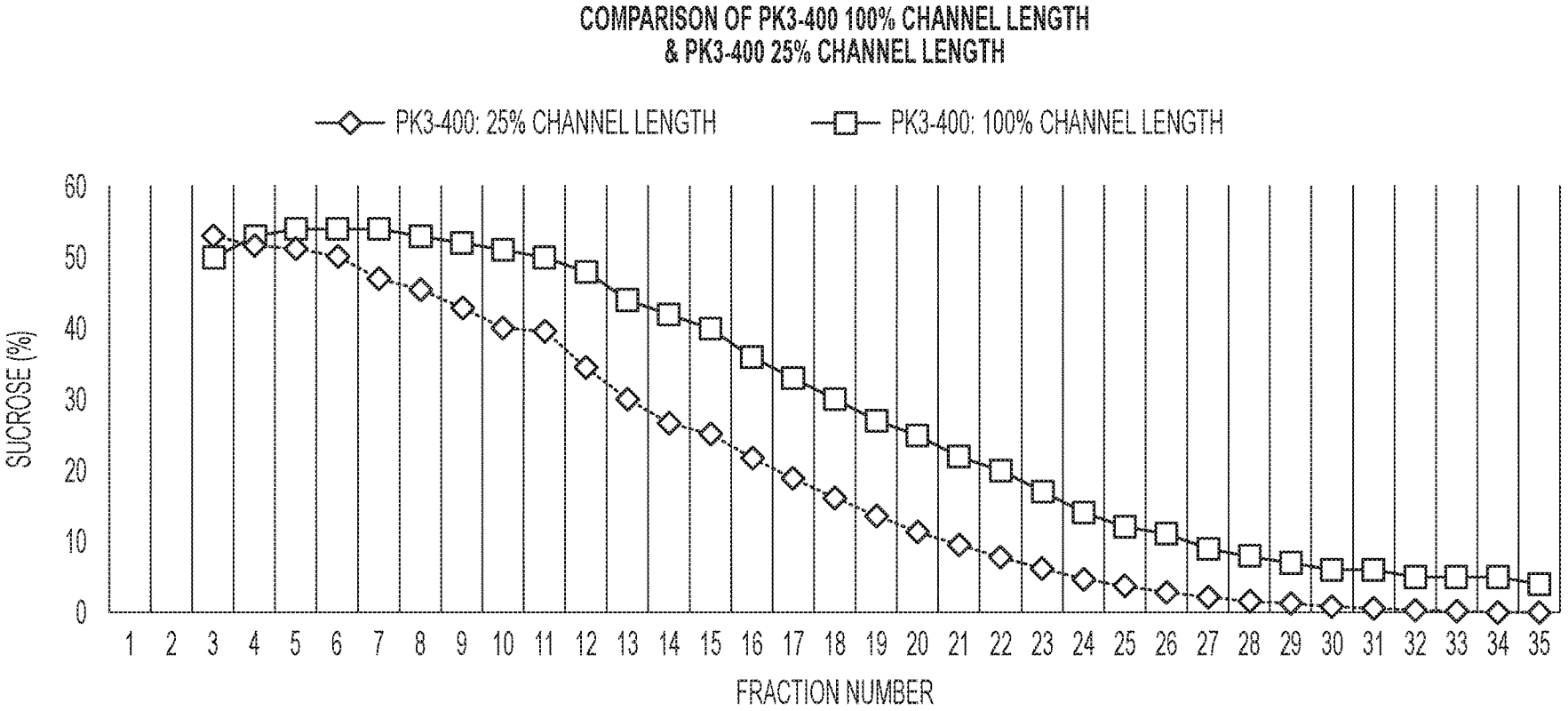
FIG. 16 is a graph comparing the performance of the rotor core as in FIG. 11 and FIG. 15.

FIG. 16 is a graph comparing the performance of rotor core 212 to the performance of the prior art rotor core 212'. During the comparison test, rotor core 212 was configured with the flow direction illustrated in FIG. 5. The standardized parameters for both tests include use of a commercially available PKII ultracentrifuge, a rotor speed of 35,000 rpm, a separation gradient that includes 200 ml load volume of 55% w/w sucrose solution and 200 ml load volume of water.

As can be seen from FIG. 16, the gradient collected from both tests illustrate a collection that is considered, for the purposes of the present application, linear with respect to one another. Thus, the results of the comparison in FIG. 16 illustrate linearity between the separation using the prior art rotor core 212' that has full length channels 214' and rotor core 212 that has the shorter, wider partial channels 214 according to the present disclosure.

Figure 17:
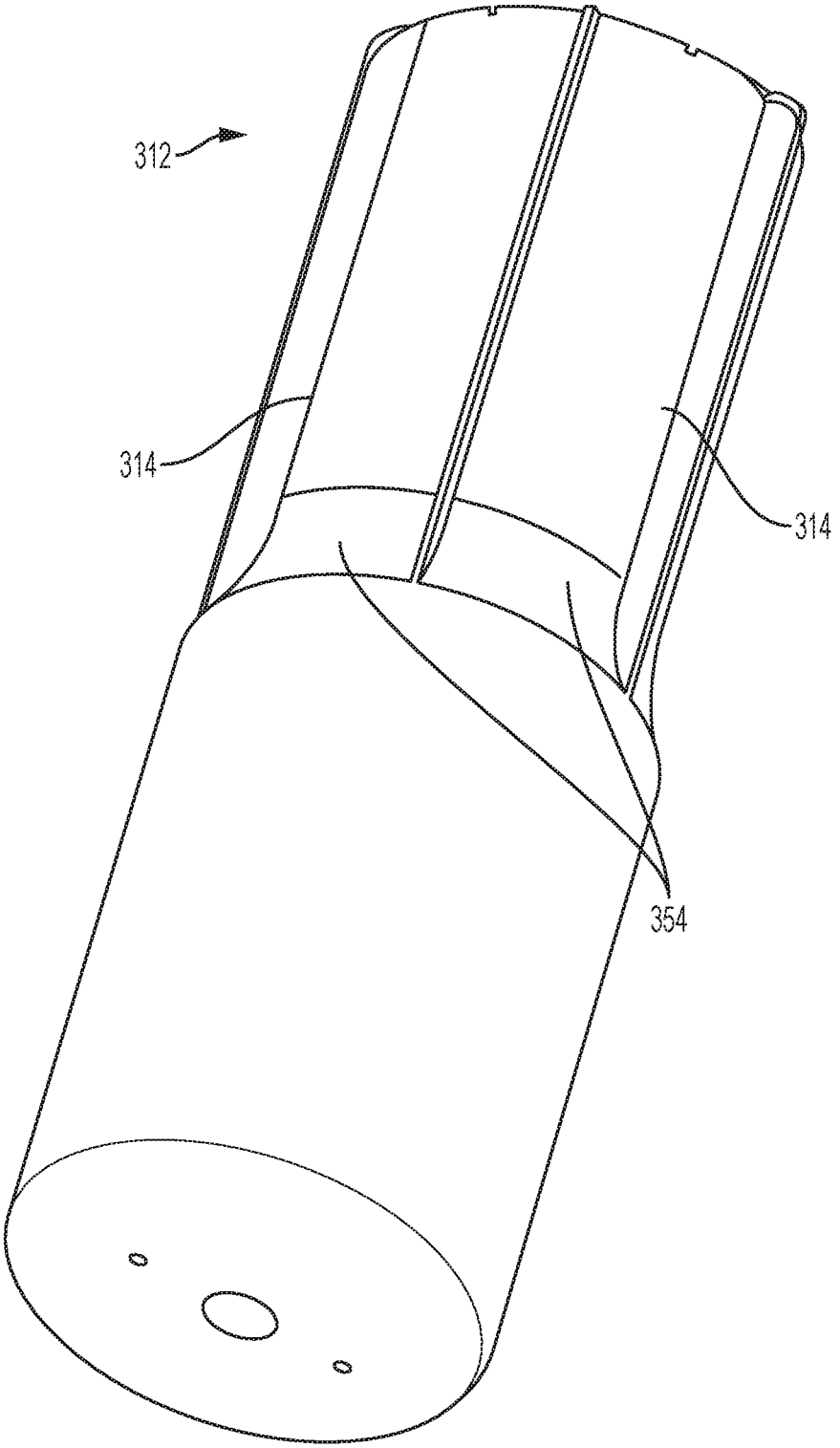
FIG. 17 is a bottom perspective view of yet another alternate exemplary embodiment of a rotor core according to the present disclosure.
Figure 18:
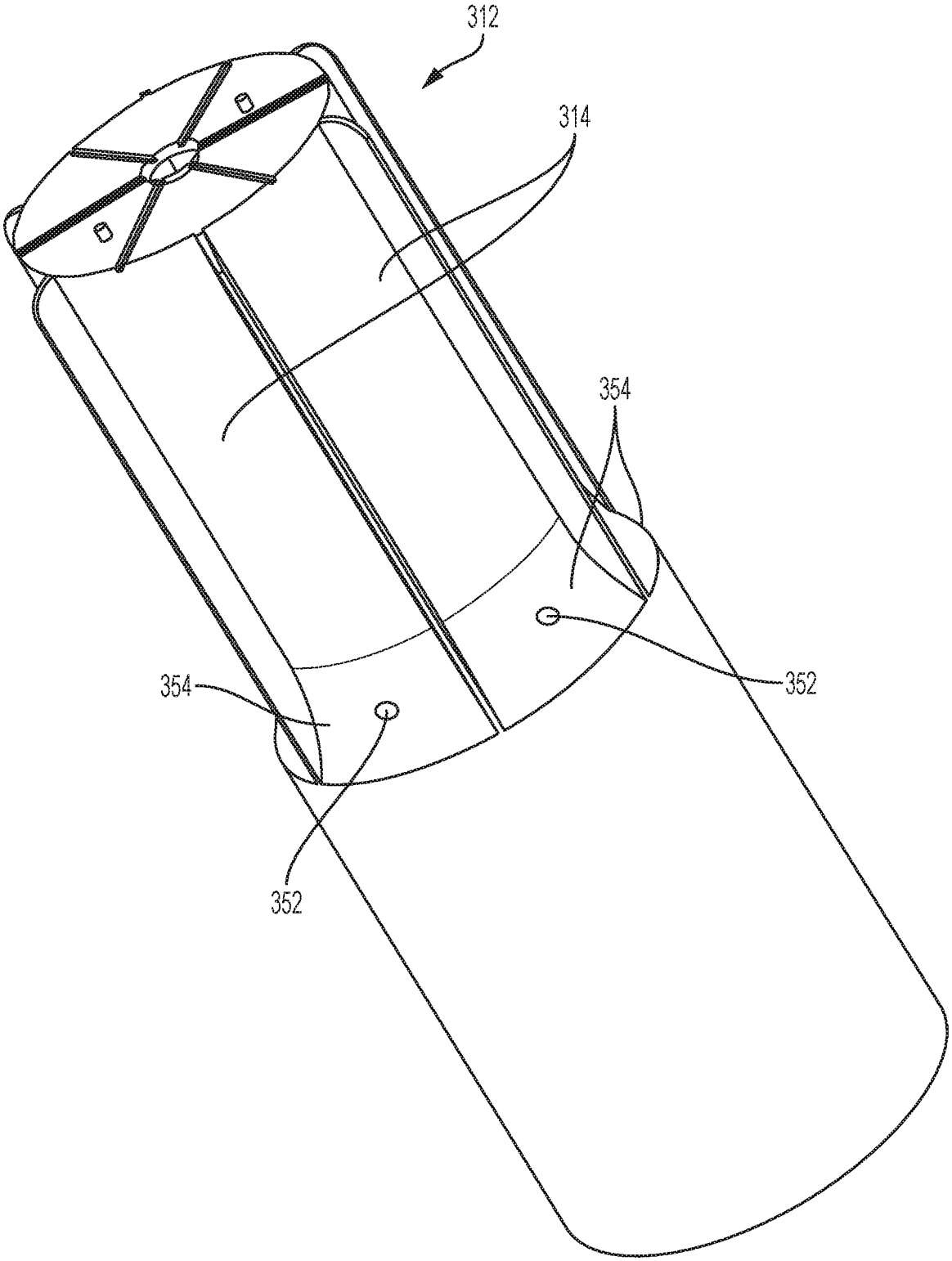
FIG. 18 is a top perspective view of the rotor core of FIG. 17.
Figure 19:
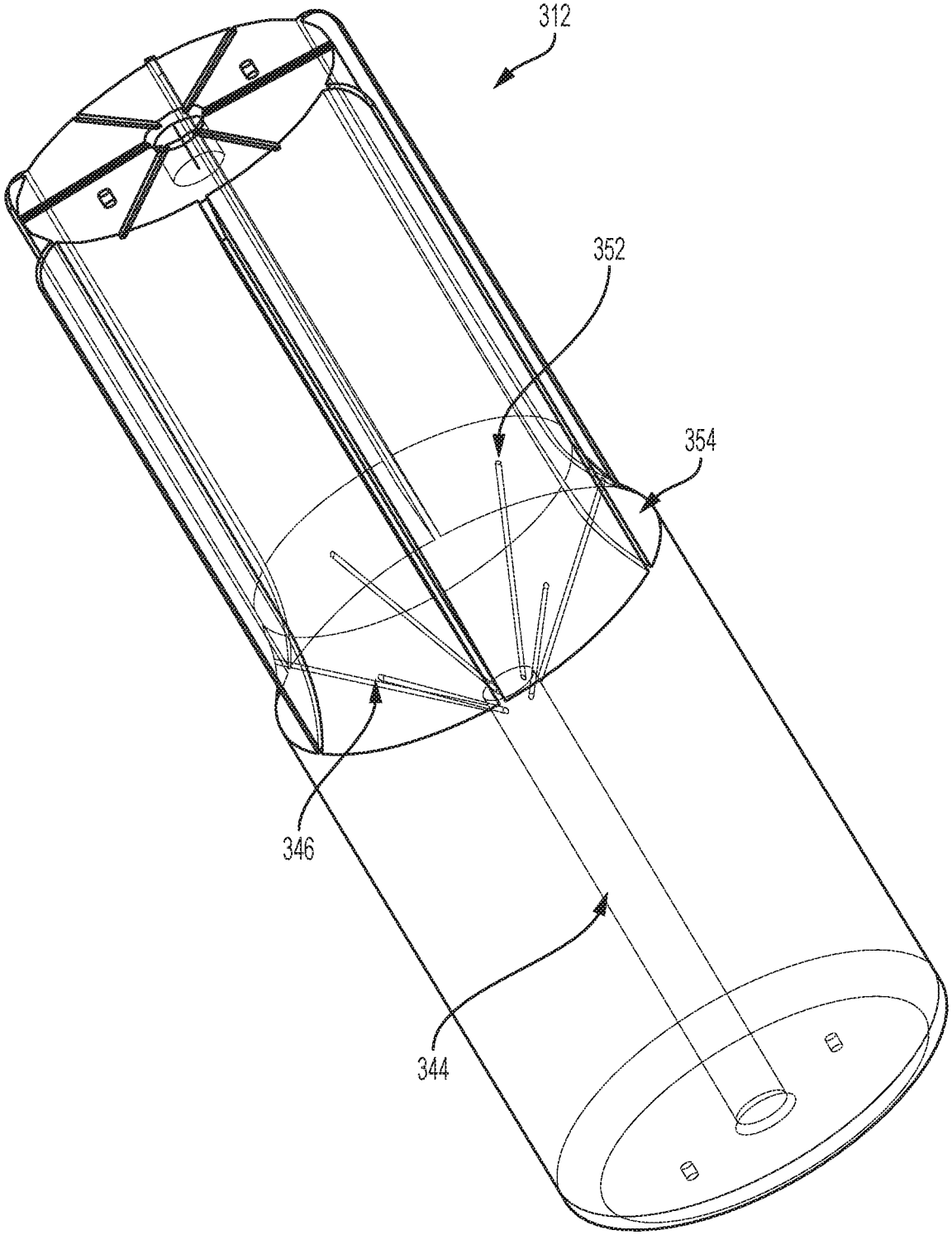
FIG. 19 is a view of the rotor core of FIG. 17 illustrating flow channels.

More features of the partial channel rotor cores of the present disclosure are disclosed with respect to FIGS. 17 through 19. Rotor core 314 illustrates an example of radial channels 346 that are angled—by a positive angle—with respect to a normal line (A).

Rotor core 314 includes a tapered region 354 within channels 314. Tapered region 354 can be used to provide further scalability to the volume of rotor core 314.

In some embodiments, axial channels 346 have ports 352 at the interface with separation channels 314 that terminate in the tapered region. Additionally and without wishing to be bound by any particular theory, termination of ports 352 in tapered region 354 is believed to reduce or mitigate effects of momentum of the analyte or analytes and/or flow through on the gradient in channels 314.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A rotor core for rotation in an outer housing, comprising:

a rotor length defined along an axis of rotation; and a plurality of centrifugation separation channels, the plurality of centrifugation separation channels having a channel length extending along the axis of rotation a distance that is less than the rotor length, wherein the plurality of separation channels have a channel width, the rotor core comprising an aspect ratio of the channel width to the channel length from 1:1 to 1:10.

2. The rotor core of claim 1, wherein the channel length is between 5% and 90% of the rotor length.

3. The rotor core of claim 1, wherein the channel length is from 1:1 to 1:5.

4. The rotor core of claim 1, further comprising a first end face and a second end face.

5. The rotor core of claim 4, wherein the plurality of separation channels intersect with only one of the first and second end faces.

6. The rotor core of claim 4, wherein the first and/or second end face comprises an insert.

7. The rotor core of claim 6, wherein the insert is integral to the first and/or second end face.

8. The rotor core of claim 6, wherein the insert is connected to, but biased away from, the first and/or second end face.

9. The rotor core of claim 4, further comprising a flow path defined by an axial channel, a plurality of radial channels, the plurality of separation channels, and a plurality of face channels, the plurality of face channels being defined in the first end face and connecting an inlet or outlet flow to the plurality of separation channels, the plurality of separation channels connecting the plurality of face channels to the plurality of radial channels, the plurality of radial channels connecting the plurality of separation channels to the axial channel, the axial channel being defined through the axis of rotation, and the axial channel connecting the plurality of radial channels to the second end face.

10. The rotor core of claim 9, wherein the first end face comprises a first insert, the flow path further comprising a plurality of insert channels, the plurality of insert channels connecting the plurality of face channels to the inlet or outlet flow.

11. The rotor core of claim 9, wherein the plurality of separation channels corresponds in number to the plurality of radial and face channels.

12. The rotor core of claim 9, further comprising a port connecting the plurality of radial channels and the plurality of separation channels, the port having a taper such that the port is wider at an interface with the plurality of separation channels than at the plurality of radial channels.

13. The rotor core of claim 9, wherein the plurality of radial channels are perpendicular to the axis of rotation.

14. The rotor core of claim 9, wherein the plurality of radial channels are angled with respect to a normal line through the axis of rotation.

15. The rotor core of claim 14, wherein the angle is between ±30 degrees.

16. The rotor core of claim 14, wherein the plurality of separation channels comprise a tapered region.

17. The rotor core of claim 16, further comprising a tapered port connecting the plurality of separation channels to the flow path, the tapered port being defined in the tapered region of the plurality of separation channels.

18. A rotor assembly comprising:

an outer housing;

a first rotor core removably disposable in the outer housing, the first rotor core having a rotor length defined along an axis of rotation, the first rotor core having a plurality of first separation channels having a first channel length that extends along the axis of rotation less than the rotor length, wherein the plurality of separation channels have a first channel width, the rotor core comprising an aspect ratio of the first channel width to the first channel length from 1:1 to 1:10.

19. The rotor assembly of claim 18, wherein the first core comprises a first end face and a second end face, the plurality of first separation channels intersecting with only one of the first and second end faces.

20. The rotor assembly of claim 18, further comprising:

a second rotor core removably disposable in the outer housing, the second rotor core having the rotor length, the second rotor core having a plurality of second separation channels having a second channel length that extends along the axis of rotation less than the rotor length.

21. The rotor assembly of claim 20, wherein the first channel length is different than the second channel length.

22. The rotor assembly of claim 20, wherein the plurality of second separation channels have a second channel width, wherein the first channel width is the same as or different from the second channel width.

23. The rotor assembly of claim 18, wherein the outer housing comprises a central portion and a pair of end caps, wherein at least one end cap of the pair of end caps is selectively removable from the central portion.

24. The rotor assembly of claim 23, wherein one end cap of the pair of end caps is permanently connected to or integrally formed with the central portion.

25. The rotor assembly of claim 18, wherein the rotor core further comprises an axial channel defined through the axis of rotation and a plurality of radial channels that pass radially through the first rotor core from the axial channel to the plurality of first separation channels, respectively.

26. A rotor assembly comprising:

an outer housing;

a rotor core removably disposable in the outer housing; and the rotor core having a plurality of centrifugation separation channels, a first end face, a second end face, and a rotor length defined along an axis of rotation between the first and second end faces, wherein the plurality of centrifugation separation channels have a channel length that extends along the axis of rotation a distance that is less than the rotor length, and wherein the plurality of centrifugation separation channels have a channel width, the rotor core comprising an aspect ratio of the channel width to the channel length from 1:1 to 1:10.

27. A rotor core, comprising:

a rotor length defined between a first end face and a second end face and along an axis of rotation;

a plurality of separation channels having a channel length extending along the axis of rotation a distance that is less than the rotor length;

an axial channel defined through the axis of rotation and extending along the axis of rotation a distance that is less than the rotor length; and a plurality of radial channels that pass radially through the rotor core from the axial channel to the plurality of separation channels, respectively, without passing over the first or second end faces.

28. The rotor core of claim 27, wherein the plurality of radial channels are perpendicular to the axis of rotation.

29. The rotor core of claim 27, wherein the plurality of radial channels are angled with respect to a normal line through the axis of rotation.

* * * * *